United States Patent [19]

Thompson

[11] Patent Number: 4,801,049

[45] Date of Patent: Jan. 31, 1989

[54] SHROUDED CONTAINER/FINGER-DEPRESSIBLE PUMP COMBINATION

[75] Inventor: Thomas E. Thompson, Jefferson City, Mo.

[73] Assignee: Chesebrough-Pond's Inc., Greenwich, Conn.

[21] Appl. No.: 19,848

[22] Filed: Feb. 27, 1987

[51] Int. Cl.[4] ..... B05B 9/043; B67D 5/42

[52] U.S. Cl. ..... 222/179.5; 222/321; 222/382; 239/333; 604/181

[58] Field of Search ..... 222/173, 179.5, 382, 222/80, 83, 87, 321, 464, 211, 153; 604/192, 193, 181, 183, 263; 206/222, 219; 92/169, 170; 239/288, 333

[56] References Cited

U.S. PATENT DOCUMENTS

| | | | |
|---|---|---|---|
| 2,896,622 | 7/1959 | Hütterman | 206/222 |
| 3,134,505 | 5/1964 | Modderno | 222/78 |
| 3,181,745 | 5/1965 | Grobowski | 222/211 X |
| 3,655,096 | 4/1972 | Easter | 206/222 |
| 4,469,253 | 9/1984 | Beard | 222/153 |

*Primary Examiner*—F. J. Bartuska

*Attorney, Agent, or Firm*—Melvin H. Kurtz

[57] ABSTRACT

A container and finger-depressible pump combination having improved non-leaking characteristics when the container holds a fluid (e.g., a volatile fluid such as nail polish remover) is described. The container which holds the fluid has a finger-depressible pump joined to its opened upper neck with the portion of the pump normally extending into the fluid in the container being encased in a closed but removable shroud which encases and isolates that portion of the pump and the adjacent portions of the pump from contact with the fluid. The shroud is a generally tubular structure being closed at its lower end and having circumferential flange means at its opposed open upper end which are adapted to be seated upon the upper land surface of the container neck underneath a portion of the cap holding the pump.

5 Claims, 2 Drawing Sheets

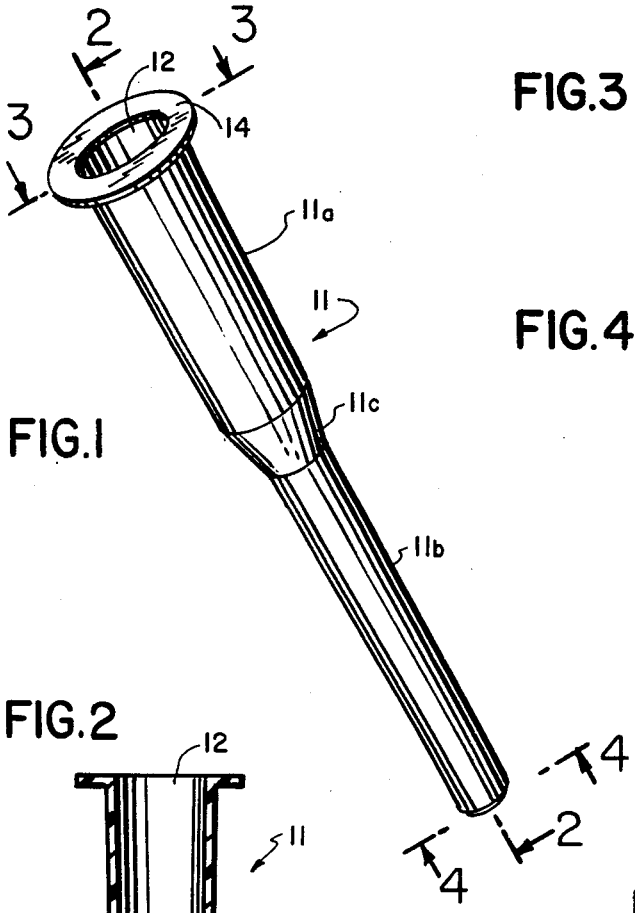
FIG.1
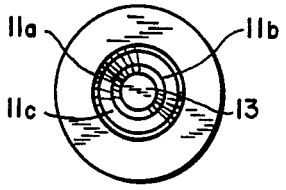
FIG.3
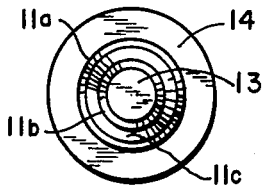
FIG.4
FIG.2
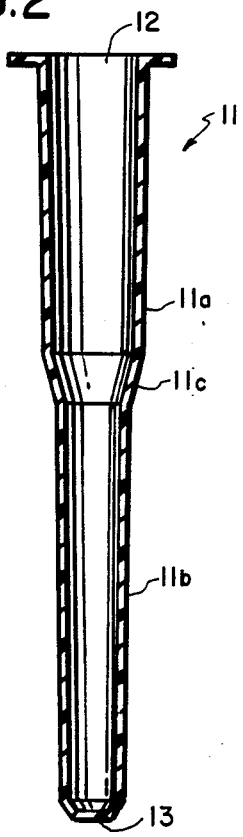
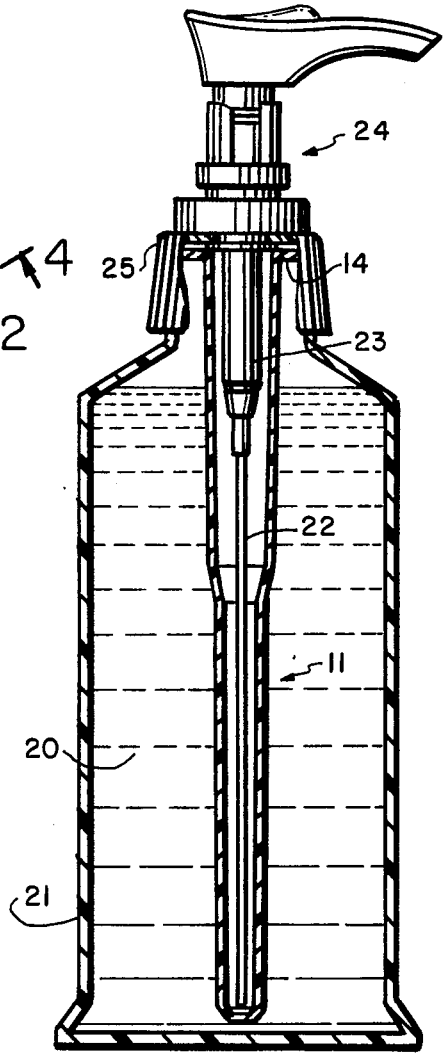
FIG.5

FIG.6
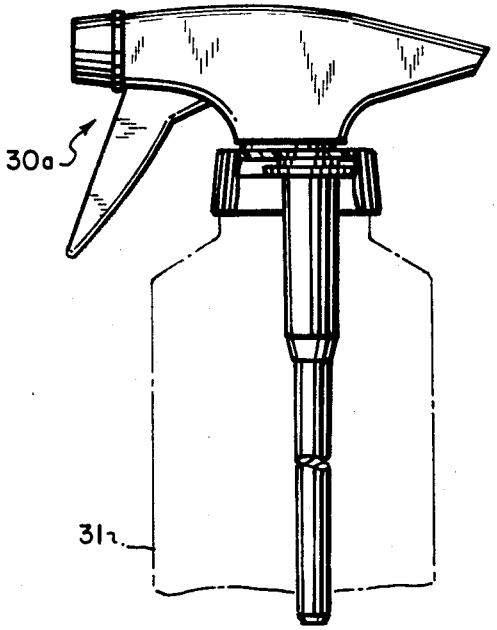
FIG.7
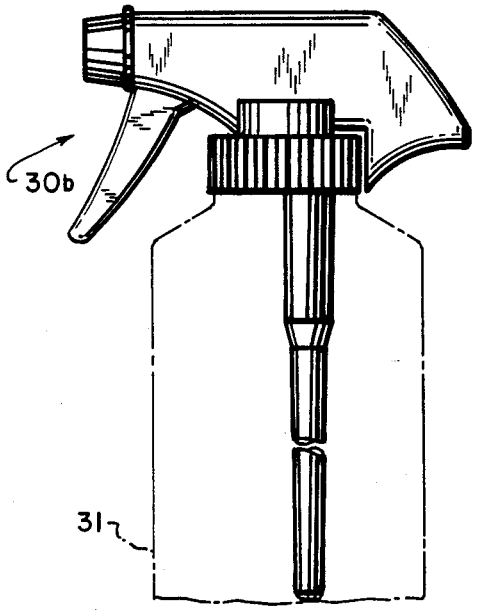
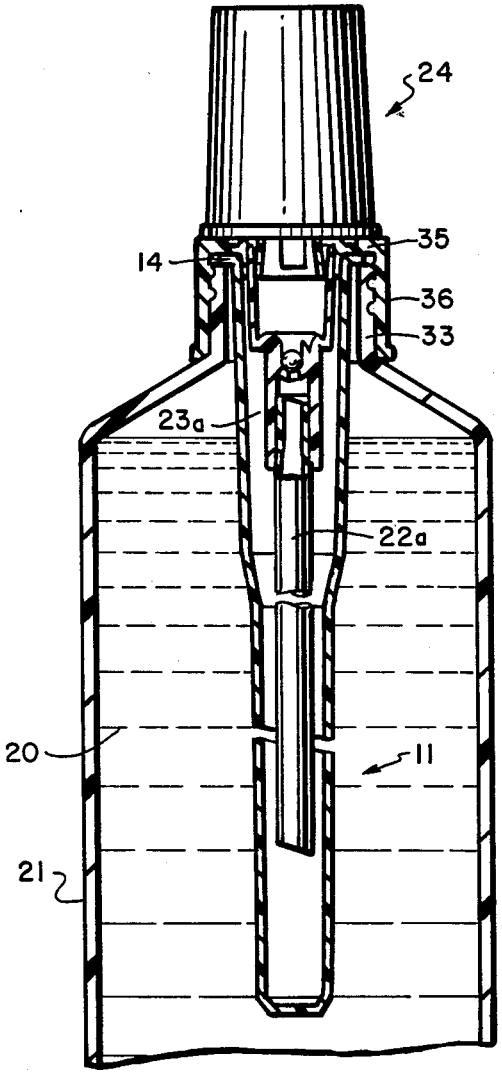
FIG.8

SHROUDED CONTAINER/FINGER-DEPRESSIBLE PUMP COMBINATION

BACKGROUND OF THE PRESENT INVENTION

Field of the Present Invention

The present invention relates to a container and finger-depressible pump combination having improved non-leaking characteristics when the container holds a fluid, for example, a volatile fluid, such as nail polish remover.

BACKGROUND OF THE PRESENT INVENTION

It is well known to use finger-depressible pumps to dispense a variety of fluids (lotions and liquids) from containers. Examples of suitable finger-depressible pumps that have been used in this manner include mechanical pumps, spray pumps and trigger sprays. A wide variety of products have been dispensed from containers having such pump mechanisms on their upper outlet opening. Mechanical pumps have been used primarily for dispensing viscous products such as liquid soap and hand and body lotion. Spray pumps have been used for such products as hair sprays, antiperspirants and fragrances. Trigger sprays are commonly used for household, chemical and automotive products.

The mechanical pump, spray pump or trigger spray pumping mechanisms conventionally employed can undesirably leak under certain circumstances when containing the fluids. This invention, in its broadest aspects, is directed to elimination of potential leakage of fluids (either lotions or liquids) from containers containing such pumps.

A preferred aspect of the present invention relates to elimination of potential leakage problems arising from the filling of such pump/container combinations with a volatile fluid, such as nail polish remover, which contains such volatile fluids as acetone, ethyl acetate, or the like. However, even though the remaining discussion focuses on this preferred use for the present invention, it is to be understood that the present invention has wider applicability and can be used to eliminate potential leakage in regard to other fluids (lotions or liquids).

The possibility of such leakage with the type of volatile fluid mentioned above, for example, can be especially prevalent during storage or transportation of the product from the factory to the consumer due to the construction features of the conventional pumps that are used. Such pumps generally are designed for the pumping of less volatile, more viscous products. The use of such pump mechanisms especially with relatively thin, volatile products, such as nail polish remover, results in the blow-by of some of the internal seals or vents in the pump, creating leakage, due to the buildup of internal pressure in the container from the greater volatility of the particular product selected. The problem of such leakage can be especially pronounced during high temperature conditions, long duration storage of the product, or transportation of the product where the container might be placed on its side bringing the volatile liquid into direct contact with the upper reaches of the container and the pumping mechanism itself, rather than merely with the lower part of the pump or dip tube.

SUMMARY OF THE PRESENT INVENTION

The present invention is a container and finger-depressible pump combination which has improved non-leaking characteristics when the container holds a fluid, such as a volatile fluid. The combination comprises a container which holds a fluid, said container terminating at its upper end in a container neck. A finger-depressible pump is joined to the neck of the container, the pump having a portion which extends into the fluid in the container. This portion preferably comprises a dip tube structure. A novel component in accordance with the present invention is a closed, but removable, shroud which encases and isolates the portion of the pump extending into the fluid and the pump mechanism itself from contact with the fluid. This shroud prevents contact of the fluid with either the pump itself or with those portions of the pump which would normally extend into the fluid. The shroud thereby seals off the pump and any associated dip tube from the fluid and obviates the possibility that the fluid can leak from the pump, e.g., from blow-by of any seals or vents contained in the pump in the case of a relatively volatile fluid.

DESCRIPTION OF THE DRAWINGS

The present invention is further understood by the Drawings which form a portion of the present specification:

FIG. 1 is a perspective view showing the shroud of the present invention;

FIG. 2 is a cross-sectional view of the shroud taken along line 2—2 of FIG. 1 in the direction of the arrows;

FIG. 3 is a top view of the shroud taken along line 3—3 of FIG. 1 in the direction of the arrows;

FIG. 4 is a bottom view of the shroud taken along FIG. 4—4 of FIG. 1 in the direction of the arrows;

FIG. 5 is a cross-sectional view of the container, the pump mechanism, the fluid in the container, and the shroud in place on the container/pump combination;

FIGS. 6 and 7 are side views showing two types of trigger spray pumps which can be used in conjunction with the shroud of the present invention, with the outlines of the bottle shown in phantom; and FIG. 8 is a partial, cross-sectional view of a container/pump combination with a differing type of pump, namely a stylized sprayer.

DETAILED DESCRIPTION OF THE PRESENT INVENTION

FIGS. 1–4 illustrate the shroud of the present invention which is used to encase and isolate a finger-depressible pump and its associated dip tube from a liquid held in the container holding the pump. The shroud 11 has a longitudinal body which is preferably of generally tubular structure having an opening 12 at one end thereof and a closed end 13 at the other end. The shroud preferably has a circumferential retaining flange 14 at the end which terminates in the opening 12. This flange 14 allows for seating of the shroud on the top land area of the container neck underneath the cap of the pump as will be described below. The shroud, preferably, comprises a relatively wide upper portion **11*a* designed to encase the wider, upper portion of the pump and a more narrow, lower portion 11*b* which is designed to encase the more narrow, lower dip tube portion of the pumping mechanism. Portions 11*a* and 11*b* of the shroud are joined together by an inwardly slanting intermediate section 11c joined to the lowermost portion of section 11a and the uppermost portion of 11b**. Most preferably, the shroud is formed of plastic, and it is of integral or one-piece construction.

FIGS. 5–8 in the Drawings show how the shroud is employed in connection with a container, a finger-depressible pump combination, and a fluid held in the container to which the pump is affixed. As would be appreciated by a person of ordinary skill in the art, the type of pumps with which the shroud of the present invention is intended to be used can vary widely in specific structure. They all have the common feature that they are finger-depressible, namely, the actuating mechanism of the pump which is used to pump liquid from the container is actuated by either depressing a plunger head or by the actuation of a trigger by the fingers of a hand. Such pumping mechanisms are generally well known, and it is not deemed that a further explanation of them is necessary. Suitable pumps of this type are available, for instance, from Calmar Inc. of Watchung, New Jersey under the designations REALEX SYSTEM 5D, TS-750 and SPRAYETTE IV.

FIG. 5 shows the shroud of the present invention in place to encase and isolate a pump dispenser (e.g., a REALEX SYSTEM 5D pump from Calmar Inc.) from a liquid 20 held within container 21. The shroud 11 encases and seals off dip tube 22 and the accumulator section 23 of the pump dispenser 24. The flange 14 of the shroud 11 lies between the top land area of the container neck and the container cap 25 holding the pump. In accordance with the present invention, it is intended that the structure shown in FIG. 5 be provided at the place of manufacture and be shipped as such for eventual sale. A person buying such a configuration need only remove the pump from the container, dispose of the shroud which is used during shipment to encase and isolate the pump from the fluid in the container, and, thereafter, reapply the pump to the container. When this is done, the pump can be actuated to dispense the fluid from the container.

FIGS. 5 and 6 illustrate two different types of trigger sprays, 30a and 30b, which can be used in conjunction with the shroud of the present invention. The shroud is not shown in these Figures and the outline of the container 31 is shown in phantom. Trigger sprays of this type are available from Calmar Inc. and each carry the designation "Model TS-750".

FIG. 8 shows the shroud of the present invention 11 in combination with a container carrying a stylized version of a mechanical sprayer system (available from Calmar Inc. as SPRAYETTE IV). The pump 24 has its accumulator 23a and dip tube 22a encased and isolated from the fluid 20 held in container 21 by the shroud. The flange 14 rests upon the upper land surface of the container neck 33 and is held tightly thereon by the lower surface of portion 35 of the cap 36 which is an integral component of the sprayer system.

The foregoing is intended to illustrate certain embodiments of the present invention and should not, therefore, be construed in a limiting sense. The scope of protection that is sought is set forth in the claims which follow.

I claim:

1. A container and finger-depressible pump combination having improved non-leaking characteristics when the container holds a liquid which comprises:

(a) a container, holding a liquid, which terminates at its upper end in a container neck and at its lower end in a bottom wall;

(b) a finger-depressible pump, removably joined to the neck of the container, said pump having a dip tube portion which extends into the container below the level of the liquid in the container to adjacent said bottom wall; and (c) a closed, removable shroud mounted on the pump, said shroud encasing and isolating the entire dip tube portion of the pump extending into the container below the liquid level and the pump from contact with the liquid.

2. A combination as claimed in claim 1 wherein the liquid is a lotion.

3. A combination as claimed in claim 1 wherein the shroud is generally tubular in shape having an opening at its upper end and flange means adjacent the opening for holding it in position.

4. A combination as claimed in claim 3 wherein the flange means are circumferential to the opening and lie between the container neck and a cap portion of the pump.

5. A combination as claimed in claim 1 wherein the shroud comprises two tubular sections of differing size.

* * * * *